United States Patent [19]

McCarthy

[11] Patent Number: 4,964,980

[45] Date of Patent: Oct. 23, 1990

[54] APPARATUS AND PROCESS FOR STABILIZING LIQUID HYDROCARBON CONDENSATE

[75] Inventor: Terry B. McCarthy, Katy, Tex.

[73] Assignee: Amoco Corporation, Chicago, Ill.

[21] Appl. No.: 224,859

[22] Filed: Jul. 27, 1988

[51] Int. Cl.[5] ..... C10G 5/00

[52] U.S. Cl. ..... 208/340; 208/341; 208/358

[58] Field of Search ..... 208/92, 93, 100, 351, 208/358, 340, 341

[56] References Cited

U.S. PATENT DOCUMENTS

| | | | |
|---|---|---|---|
| 2,072,456 | 3/1937 | Keith, Jr. | 208/351 |
| 2,134,836 | 11/1938 | Ostergaard | 208/340 |
| 2,204,285 | 6/1940 | Smith | 208/358 |
| 2,221,702 | 11/1940 | Eaton | 208/358 |
| 2,281,282 | 4/1942 | Gerhold | 208/351 |
| 3,595,782 | 7/1971 | Bucklin et al. | 208/340 |

*Primary Examiner*—Glenn Caldarola
*Attorney, Agent, or Firm*—F. E. Hook

[57] ABSTRACT

Stabilized liquid hydrocarbon condensate is obtained by a process comprising the steps of:

(a) introducing said condensate, at an elevated temperature and pressure, into a stabilizer column operated under conditions effective to separate said condensate into (i) a liquid portion which is a stabilized condensate comprising n-$C_4$t hydrocarbons, and (ii) a gaseous portion, which comprises $CO_2$ and normally gaseous hydrocarbons (b) withdrawing said liquid portion, (i), from said stabilizer and dividing it into a stabilized condensate product stream that is recovered and a recycle stream that is cooled and reintroduced as liquid feed into said stabilizer column; and (c) withdrawing said gaseous portion, (ii), from said stabilizer column.

7 Claims, 3 Drawing Sheets

APPARATUS AND PROCESS FOR STABILIZING LIQUID HYDROCARBON CONDENSATE

FIELD OF THE INVENTION

This invention pertains to an apparatus and method for stabilizing liquid hydrocarbon condensates. The invention is particularly suitable for processing liquid condensates from $CO_2$ recovery facilities where the condensate contains carbon dioxide ($CO_2$) as well as normally gaseous hydrocarbons as volatile components that must be removed from the condensate so that it may be stored at atmospheric conditions.

TECHNICAL BACKGROUND

The "Manual of Oil and Gas Terms" by Williams and Meyers, Seventh Edition (1987) defines a stabilized liquid hydrocarbon as:

"The product of a production operation in which the entrained gaseous hydrocarbons have been removed to the degree that said liquid may be stored at atmospheric conditions. 16 Tax Admin. Code §3.36(b)(2)."

When the production operator has a $CO_2$ flooding operation, the liquid hydrocarbon condensate that is produced contains $CO_2$ as a volatile component in addition to the entrained gaseous hydrocarbons. In addition, hydrogen sulfide ($H_2S$) can also be present when the hydrocarbon condensate is produced from a "sour" well. It is important to remove the normally gaseous hydrocarbons (e.g., methane, ethane, propane, isobutane), $CO_2$, $H_2S$, and any other volatile components from the liquid hydrocarbon condensate in order to obtain a stabilized condensate that can be safely and conveniently stored and processed at atmospheric conditions. It is also important to stabilize the liquid condensate in a manner that permits recovery of the volatile components in order to maximize the economics of the process.

The problem of stabilizing liquid hydrocarbon condensate in an economic manner is not new, of course, and many methods have been described in the literature for stabilizing liquid condensate. The following patents are illustrative:

U.S. Pat. Nos. 4,459,142 and 4,466,946 describe processes for separating carbon dioxide and other volatiles from a hydrocarbon stream. One or more stabilizer columns was utilized in both instances to separate the natural gas liquids (NGL) from the gaseous components. Condensate knocked out during processing of carbon dioxide-rich gases associated with EOR projects requires special handling so that a stabilized condensate can be produced that will meet sales product specifications normally based on a Reid vapor pressure close to atmospheric pressure. Stabilization of the condensate requires removal of not only carbon dioxide but also light hydrocarbons (i.e., methane, ethane, propane and isobutane). The heavier hydrocarbons (i.e., n-butane-plus fraction) is recovered as stabilized condensate in the bottom product of the fractionator. The overhead vapor product from the condensate stabilizer can be further treated for removal and recovery of carbon dioxide for injection while the hydrocarbons can be further processed in a gas plant. For a total or partial fractionator to be utilized to obtain the necessary condensate stabilization, typical designs require two fractionators to operate in series with the overhead temperature of the first column to be below zero in order that reflux requirements can be achieved. With temperatures at this level, water removal of the feed stream is necessary to prevent hydrate formation within the column.

U.S. Pat. No. 3,244,600 describes an apparatus for removing volatile hydrocarbons from raw streams of liquid petroleum and U.S. Pat. No. 2,367,862 describes a method of stabilizing gasoline, a multicomponent hydrocarbon liquid. These patents are incorporated herein by reference. In spite of the progress that these inventors may have made to the arts and useful sciences, there still exists a need for an economic method and apparatus for stabilizing liquid hydrocarbon condensate, particularly condensate containing $CO_2$ and/or $H_2S$.

SUMMARY OF THE INVENTION

A novel method and apparatus for stabilizing liquid hydrocarbon condensate has now been discovered.

The process comprises the steps of:

(a) introducing said condensate, at an elevated temperature and pressure, into a stabilizer fractionator with a partial condenser column operated under conditions effective to separate said condensate into (i) a liquid portion which is a stabilized condensate comprising n-$C_4$+ hydrocarbons, and (ii) a gaseous portion, which comprises $CO_2$ and normally gaseous hydrocarbons;

(b) withdrawing said liquid portion, (i), from said stabilizer column and dividing it into a stabilized condensate product stream that is recovered and a recycle stream that is cooled and reintroduced into said stabilizer in the upper portion of the column; and (c) withdrawing said gaseous portion, (ii), from said stabilizer column.

The new process is an economic method of stabilizing liquid condensate and it can be used effectively to stabilize condensate containing $CO_2$ and/or $H_2S$. The process takes a slip stream of the liquid bottom product (i.e., condensate) from a single fractionation tower (i.e., stabilizer column) and recycles that stream as a feed stream which is introduced in the upper portion of the stabilizer column. The slip stream or recycle stream is normally about 15 to about 40 volume percent of the liquid bottom product withdrawn from the stabilizer column, and is preferably about 20 to about 35 volume percent. The condensate product from this process has properties (e.g., Reid Vapor Pressure) similar to stabilized condensate obtained from extractive distillation processes having two, three and even four tower systems. The benefits of the new process over previous designs for similar applications include (1) elimination of low-level refrigeration for overhead condensation, (2) elimination of feedstream dehydration, and (3) use of a single column for fractionation. No apparent azeotropic composition is formed or broken during the process and the recycle stream of bottom product is effectively recovered in the process.

As noted, the gaseous (volatile) components (i.e., methane, ethane, propane, iso-butane, $CO_2$, $H_2S$, etc.) are removed overhead from the stabilizer column through line 105. The gas stream passes through stabilizer overhead condenser G8-653, where it is cooled, into stabilizer reflux accumulator (V8-651), where any condensed liquids are separated and returned under pressure (provided by pump E10-651-1) as reflux to the upper section of the stabilizer column by line 108 and where any gaseous components are taken overhead through line 110. The gaseous overhead fluids from the reflux accumulator are normally passed through line 110 for further processing. In the embodiment shown, the gaseous overhead fluid passes into a stabilizer overhead compressor section scrubber (V8-653) and compressor (E4-651-1) to pressurize the products to pipeline pressures for transport and further processing. The stabilizer reflux accumulator is also equipped with a liquid level control system having a sensor and a controller that opens and closes valve V112 in line 108.

Figure 1:
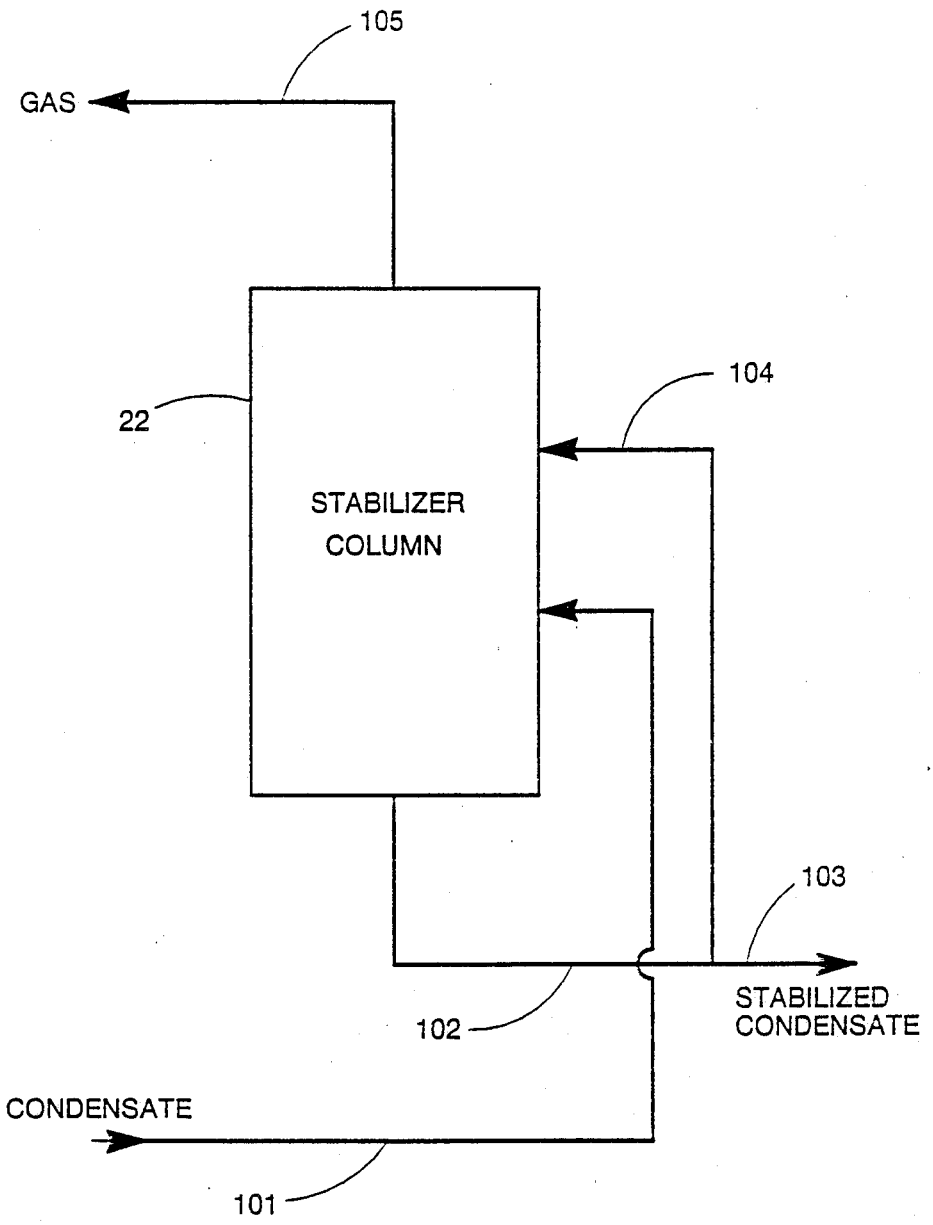
FIG. 1 is a flow diagram illustrating the novel process and one arrangement of equipment and piping. Liquid hydrocarbon condensate containing volatile components dissolved or entrained in the liquid is introduced thru line 101 into the stabilizer column (22), generally in the middle portion of the column. The stabilizer column is operated under conditions (e.g., temperature, pressure, number of trays, flow-rate, etc.) effective in separating the volatile components from the higher boiling point liquid components in the liquid condensate. The volatile components are removed as overheads from the column through line 105 and the stabilized liquid condensate product is removed as a bottoms product through line 102. A portion of the stabilized condensate is recycled through line 104 back to the column as a feed stream and is introduced generally in the upper portion of the column. The remainder of the stabilized condensate is carried through line 103 to storage where the product is collected for sales or further processing.
Figure 2:
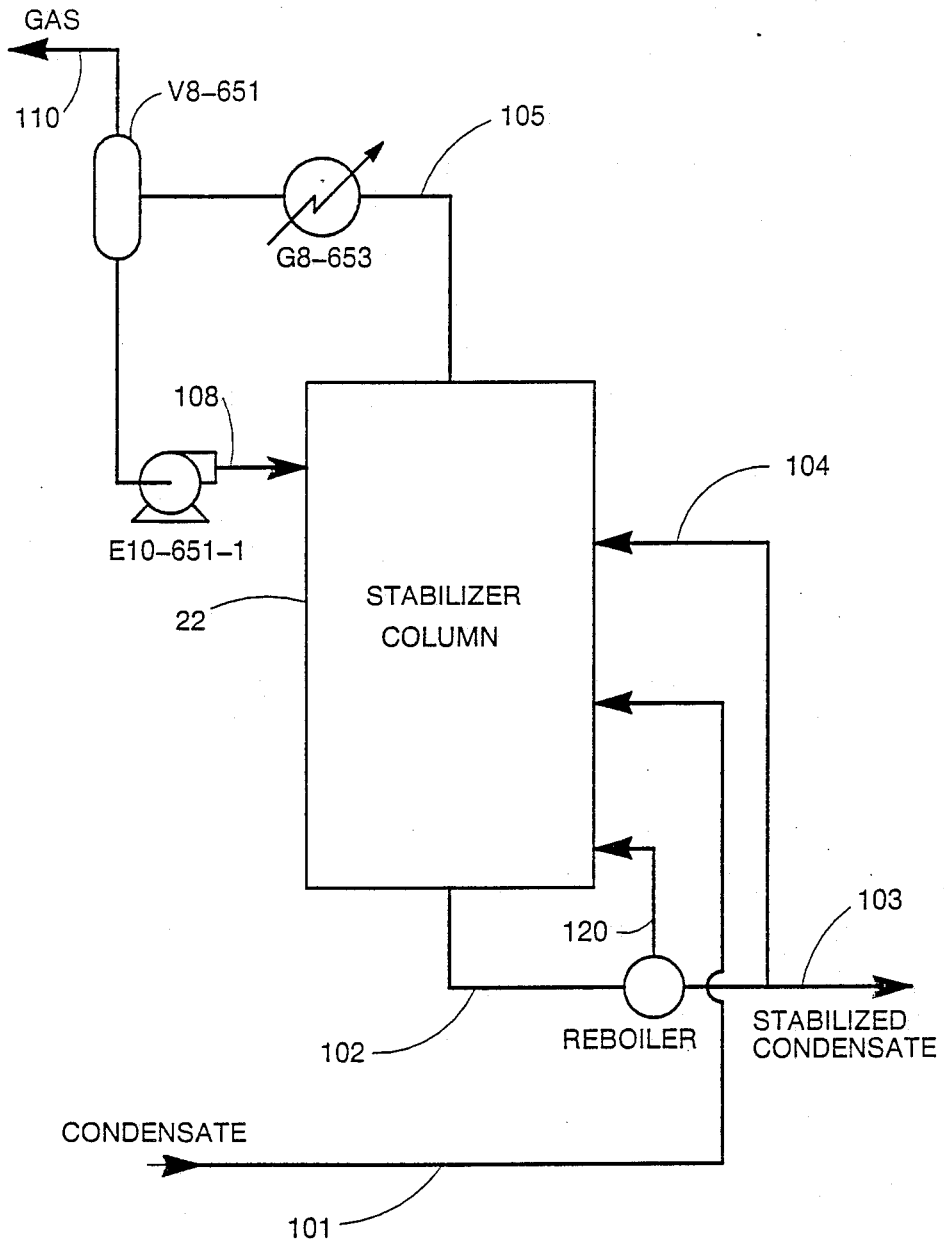
FIG. 2 is a flow diagram patterned after FIG. 1, but showing certain preferred embodiments. In one preferred embodiment, the gaseous overhead materials in line 105 are partially condensed in condenser (G8-653), and the liquid thus condensed is recycled to the upper portion of the stabilizer column through line 108 while the remaining gaseous material flows through line 110 for recovery or further processing. In another preferred embodiment, the liquid condensate is withdrawn from the bottom of the stabilizer column through line 102, heated to promote further separation of volatile components, and the heated gases which separate from the stabilized liquid condensate are returned to the lower portion of the stabilizer column through line 120.
Figure 3:
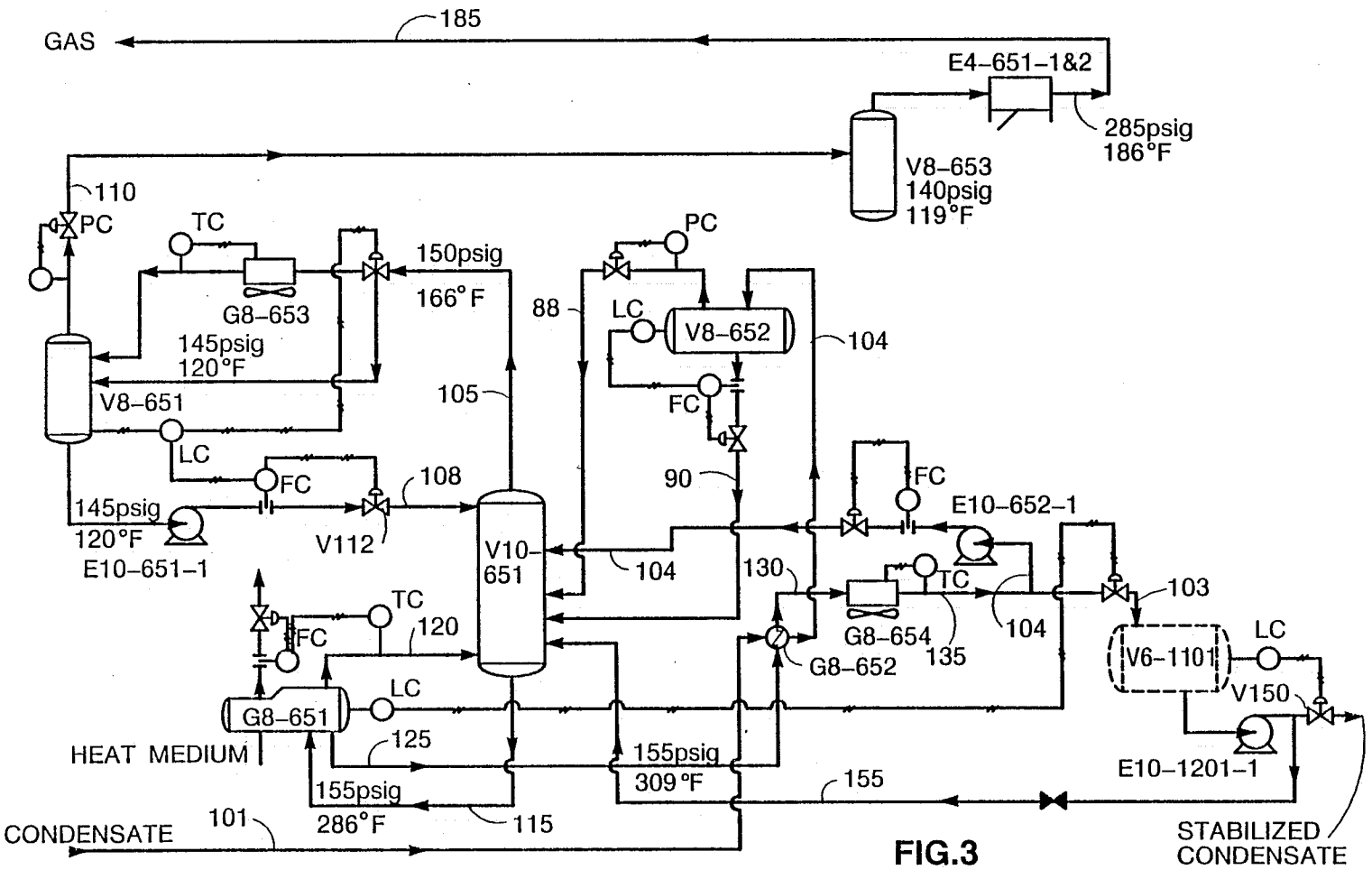
FIG. 3 is another flow diagram illustrating the invention, but with more detail regarding preferred embodiments. Condensate feed stream 101 is warmed as it passes through heat exchanger G8-652, and then passes through line 104 to stabilizer feed drum V8-652. Some gas/liquid separation occurs in the stabilizer feed drum and any gaseous components which separate from the liquid in the feed drum are fed into the stabilizer column (V10-651) through line 88 and the remaining liquid condensate is fed through line 90 into the stabilizer column, typically at the mid-section of the stabilizer column. The liquid level in the feed drum is maintained by a convention control system having a sensor and a controller which opens/closes the valve as needed. Additional gas/liquid separation occurs in the stabilizer column and the volatile components are taken overhead through line 105 while the stabilized condensate is recovered as a liquid bottoms product. The stabilizer column is operated at conditions to separate volatile components in quantities sufficient to obtain a stabilized liquid condensate. Typically, the stabilizer column is operated at elevated temperatures and pressures as a fractionation column with a continuous flow of feed and removal of gaseous/liquid streams from the column.

The stabilized liquid condensate flows through line 115 into stabilizer reboiler (G8-651) wherein it is heated and divided into a first portion that is recycled to the stabilizer column through line 120 and a second portion. The second portion of heated condensate passes through line 125 into heat exchanger G8-652 (where it is cooled), into line 130 where it passes through cooler G8-654 (where it is further cooled) and into line 135 where the condensate stream is split into a recycle portion (line 104) and a product portion (line 103). The recycle portion is pressurized by pump E10-652-1 and returned as a feed stream to the upper portion of the stabilizer column by line 104. The product portion is, of course, the stabilized liquid condensate product. The product portion passes through line 103 into a storage tank V6-1101, and from there delivered to sales or further processing at pump pressures. The storage tank (V6-1101) is also equipped with a liquid control mechanism having a sensor and a controller that operates valve V-150. A start-up line 155 is also indicated in FIG. 2. Normally, there is no flow in this line, but stabilized liquid condensate can be returned to the lower portion of the stabilizer column in the event of shutdown and start-up of the system.

EXPERIMENTAL

The temperatures and pressures of the fluid streams in the various lines in FIG. 2 are shown for a specific run conducted on condensate feed obtained from a $CO_2$ enhanced flooding operation in Hockley County, Tex. The liquid chemical composition of the various fluid streams is summarized in Table I below. The recycle stream returned to the stabilized column via line 104 represented from about 25 to about 33 volume percent of the liquid flowing in line 135. The data show the high degree of effectiveness in separating the gaseous components from a liquid condensate using a single fraction column as a stabilizer column according to the claimed process.

TABLE I

| Stream Number Description/Component | 88 Stabilizer Feed Vapor | 90 Stabilizer Feed Liquid | 108 Stabilizer Reflux | 115 Liquid to Stabilizer Reboiler | 120 Vapor From Stabilizer Reboiler | 105 Stabilizer Overhead Vapor | 103 Stabilized Product | 104 Stabilized Condensate As Recycle | 110 Stabilizer Overhead Product |
|---|---|---|---|---|---|---|---|---|---|
| $H_2O$ | 0.17 | 0.03 | 0.02 | — | — | 0.22 | — | — | 0.20 |
| $N_2$ | 0.31 | 0.01 | 0.01 | — | — | 0.33 | — | — | 0.32 |
| $C_1$ | 6.05 | 0.38 | 0.32 | — | — | 6.75 | — | — | 6.43 |
| $CO_2$ | 29.13 | 3.38 | 3.14 | — | — | 35.65 | — | — | 32.51 |
| $C_2$ | 7.63 | 1.44 | 1.84 | 0.00 | 0.00 | 10.91 | — | — | 9.07 |
| $H_2S$ | 0.42 | 0.10 | 0.15 | 0.00 | 0.00 | 0.67 | — | — | 0.52 |
| $C_3$ | 15.58 | 6.25 | 11.88 | 0.74 | 0.59 | 33.61 | 0.10 | 0.05 | 21.73 |
| $iC_4$ | 5.61 | 4.08 | 10.14 | 7.08 | 5.13 | 18.53 | 1.30 | 0.65 | 8.39 |
| $nC_4$ | 13.39 | 11.89 | 28.21 | 33.63 | 23.40 | 46.67 | 6.82 | 3.41 | 18.46 |
| $iC_5$ | 7.86 | 12.04 | 12.68 | 59.64 | 35.98 | 16.81 | 15.77 | 7.89 | 4.13 |

TABLE I-continued

| Stream Number Description/Component | 88 Stabilizer Feed Vapor | 90 Stabilizer Feed Liquid | 108 Stabilizer Reflux | 115 Liquid to Stabilizer Reboiler | 120 Vapor From Stabilizer Reboiler | 105 Stabilizer Overhead Vapor | 103 Stabilized Product | 104 Stabilized Condensate As Recycle | 110 Stabilizer Overhead Product |
|---|---|---|---|---|---|---|---|---|---|
| $nC_5$ | 10.15 | 18.10 | 12.41 | 87.12 | 50.13 | 16.00 | 24.66 | 12.33 | 3.59 |
| $C_6$ | 5.58 | 21.69 | 1.42 | 71.67 | 30.96 | 1.55 | 27.14 | 13.57 | 0.13 |
| CUT 1 | 3.04 | 19.02 | 0.38 | 50.80 | 17.75 | 0.40 | 22.03 | 11.02 | 0.02 |
| CUT 2 | 0.83 | 10.14 | 0.04 | 21.84 | 5.38 | 0.04 | 10.96 | 5.50 | 0.00 |
| CUT 3 | 0.17 | 4.25 | 0.00 | 7.91 | 1.27 | 0.00 | 4.42 | 2.22 | — |
| CUT 4 | 0.03 | 1.43 | — | 2.45 | 0.25 | — | 1.46 | 0.74 | — |
| CUT 5 | 0.00 | 0.45 | — | 0.73 | 0.05 | — | 0.45 | 0.23 | — |
| CUT 6 | — | 0.11 | — | 0.17 | 0.01 | — | 0.11 | 0.05 | — |
| CUT 7 | — | 0.09 | — | 0.14 | 0.00 | — | 0.09 | 0.05 | — |
| Total Mol/Hr | 105.95 | 114.88 | 82.64 | 343.92 | 170.90 | 188.14 | 115.31 | 57.71 | 105.50 |
| MMSCFD @ 14.65 psia/60° F. | 0.97 | — | — | — | 1.56 | 1.72 | — | — | 0.96 |
| #/Hr | 5632 | 9370 | 4933 | 28280 | 13166 | 9859 | 10077 | 5037 | 4926 |
| Mol. Wt. | 53.16 | 81.56 | 59.68 | 82.23 | 77.04 | 52.40 | 87.36 | 87.36 | 46.69 |
| Density (lb/Ft$^3$) @ P, T | 1.52 | 35.66 | 34.04 | 32.51 | 1.943 | 1.47 | 40.29 | 40.31 | 1.34 |
| GPM @ P, T | — | 32.76 | 18.06 | 108.44 | — | — | 31.18 | 15.58 | — |
| Viscosity (CP) @ P, T | 0.012 | 0.166 | 0.143 | 0.113 | 0.011 | 0.011 | 0.277 | 0.278 | 0.011 |
| Temperature (°F.) | 218 | 218 | 120 | 286 | 309 | 166 | 120 | 120 | 120 |
| Pressure (psig) | 172 | 172 | 145 | 155 | 155 | 150 | 145 | 180 | 145 |

I claim:

1. A method for stabilizing condensate from a $CO_2$ recovery plant comprising the steps of:

(a) introducing said condensate, at an elevated temperature and pressure, into a stabilizer column operated under conditions effective to separate said condensate into (i) a liquid portion which is a stabilized condensate comprising $n-C_4+$ hydrocarbons, and (ii) a gaseous portion, which comprises $CO_2$ and normally gaseous hydrocarbons;

(b) withdrawing said liquid portion, (i), from said stabilizer and dividing it into a stabilized condensate product stream that is recovered and a recycle stream that is cooled and the cooled recycle stream is reintroduced as liquid feed into said stabilizer column; and (c) withdrawing said gaseous portion, (ii), from said stabilizer column.

2. The method defined by claim 1 wherein said gaseous portion withdrawn in step (c) is cooled and any liquid condensed is reintroduced as reflux into said stabilizer column near the top of said stabilizer column.

3. The method defined by claim 1 wherein a portion of said liquid portion, (i), is withdrawn, heated, and any gaseous portion that separates is reintroduced into said stabilizer column near the bottom of said stabilizer column.

4. The method defined by claim 1 wherein:

(a) a portion of said gaseous portion withdrawn in step (c) is cooled and reintroduced into said stabilizer column near the top of said stabilizer column, and wherein (b) a portion of said liquid portion, (i), is withdrawn, heated and reintroduced into said stabilizer column near the bottom of said stabilizer column.

5. The method defined by claim 4 wherein the streams of stabilized condensate and gaseous portions reintroduced into the stabilizer column are at a temperature of about 110° to about 150° F. and a pressure of about 125 to about 200 psig.

6. The method defined by claim 5 wherein the streams of stabilized condensate and gaseous portions reintroduced into the stabilizer column are at a temperature of about 110° and about 130° F. and a pressure of about 140 to about 190 psig.

7. The method defined by claim 1 wherein said condensate is passed into and through a stabilizer feed drum wherein at least a part of the volatile components which are dissolved and/or entrained in said condensate are separated from the liquid condensate and introduced into the stabilizer column near the mid-point of said stabilizer column and slightly below the point where the liquid portion of the condensate is introduced.

* * * * *